US008480858B2

(12) United States Patent
Kylliainen et al.

(10) Patent No.: US 8,480,858 B2
(45) Date of Patent: Jul. 9, 2013

(54) BOARD OR PAPER PRODUCED IN AN ARRANGEMENT IN CONNECTION WITH THE PRESS SECTION OF A WEB-FORMING MACHINE

(71) Applicants: Pekka Kylliainen, Imatra (FI); Kari Raisanen, Jyvaskyla (FI)

(72) Inventors: Pekka Kylliainen, Imatra (FI); Kari Raisanen, Jyvaskyla (FI)

(73) Assignees: Stora Enso Oyj, Helsinki (FI); Metso Paper, Inc., Helsinki (FI)

( * ) Notice: Subject to any disclaimer, the term of this patent is extended or adjusted under 35 U.S.C. 154(b) by 0 days.

(21) Appl. No.: 13/624,402

(22) Filed: Sep. 21, 2012

(65) Prior Publication Data

US 2013/0020044 A1 Jan. 24, 2013

Related U.S. Application Data

(62) Division of application No. 12/746,790, filed as application No. PCT/FI2008/050724 on Dec. 10, 2008.

(30) Foreign Application Priority Data

Dec. 20, 2007 (EP) ..... 07150199

(51) Int. Cl.

| | |
|---|---|
| ***D21F 3/02*** | (2006.01) |
| ***D21F 3/04*** | (2006.01) |
| ***D21F 5/04*** | (2006.01) |
| ***D21F 5/18*** | (2006.01) |
| ***D21G 1/00*** | (2006.01) |

(52) U.S. Cl.

USPC ..... 162/358.4; 162/358.5; 162/359.1; 162/361; 34/116

(58) Field of Classification Search

USPC ..... 162/289–290, 358.1–358.5, 359.1, 162/361; 34/398, 400, 419, 108, 116, 132; 100/92, 153, 155 R

See application file for complete search history.

(56) References Cited

U.S. PATENT DOCUMENTS

| | | | | |
|---|---|---|---|---|
| 3,354,035 | A | 11/1967 | Gottwald et al. | |
| 4,566,946 | A * | 1/1986 | Koponen et al. | 162/359.1 |
| 4,596,633 | A | 6/1986 | Attwood | |
| 4,738,752 | A * | 4/1988 | Busker et al. | 162/358.5 |
| 5,131,983 | A * | 7/1992 | Pulkowski et al. | 162/358.5 |
| 5,255,447 | A | 10/1993 | Christ | |
| 5,308,441 | A | 5/1994 | Kern | |
| 5,540,885 | A | 7/1996 | Pahlmark et al. | |

(Continued)

FOREIGN PATENT DOCUMENTS

| | | |
|---|---|---|
| DE | 10116840 | 10/2002 |
| DE | 102005021106 A1 * | 11/2006 |

(Continued)

*Primary Examiner* — Jose A Fortuna
(74) *Attorney, Agent, or Firm* — Fildes & Outland, P.C.

(57) ABSTRACT

The invention relates to an arrangement in connection with the press section of a web-forming machine. The arrangement includes at least one press nip for dewatering the web manufactured on a web-forming machine. The arrangement also includes a smoothing press including a smoothing roll arranged after the press nip. The smoothing press includes smooth heat carrying devices arranged as a loop around at least two guide rolls. The smoothing roll is arranged into contact with the devices between two guide rolls. The smoothing roll and/or at least one of the guide rolls is a steam heated drying cylinder or a steam heated roll modified thereof. The invention also relates to a board or paper produced in such arrangement.

11 Claims, 2 Drawing Sheets

U.S. PATENT DOCUMENTS

| | | | | |
|---|---|---|---|---|
| 5,662,778 | A * | 9/1997 | Laapotti | 162/360.2 |
| 5,665,206 | A * | 9/1997 | Niskanen | 162/206 |
| 5,670,023 | A * | 9/1997 | Steiner et al. | 162/359.1 |
| 5,694,837 | A | 12/1997 | Neider et al. | |
| 5,705,034 | A * | 1/1998 | Schiel | 162/205 |
| 6,136,154 | A * | 10/2000 | Kotitschke et al. | 162/360.3 |
| 6,221,212 | B1 | 4/2001 | Sjostrom | |
| 6,274,001 | B1 | 8/2001 | Mohan | |
| 6,332,953 | B1 * | 12/2001 | Singh et al. | 162/134 |
| 6,397,739 | B1 * | 6/2002 | Viljanmaa | 100/38 |
| 6,497,790 | B2 | 12/2002 | Mohan et al. | |
| 6,878,236 | B2 | 4/2005 | Tienvieri et al. | |
| 6,923,889 | B2 | 8/2005 | Huuskonen et al. | |
| 6,994,771 | B1 * | 2/2006 | Korhonen et al. | 162/202 |
| 7,000,536 | B2 * | 2/2006 | Laitila et al. | 100/153 |
| 7,601,244 | B2 * | 10/2009 | Iijima et al. | 162/360.2 |
| 7,704,351 | B2 | 4/2010 | Lipponen et al. | |
| 7,897,011 | B2 | 3/2011 | Peng et al. | |
| 7,943,010 | B2 | 5/2011 | Pietikainen et al. | |
| 2002/0060005 | A1 | 5/2002 | Mohan et al. | |
| 2004/0035302 | A1 * | 2/2004 | Laitila et al. | 100/153 |
| 2004/0180184 | A1 | 9/2004 | Fillion et al. | |
| 2005/0251976 | A1 | 11/2005 | Lipponen et al. | |
| 2005/0251977 | A1 | 11/2005 | Lipponen et al. | |
| 2006/0011319 | A1 * | 1/2006 | Honkalampi et al. | 162/205 |
| 2006/0060322 | A1 * | 3/2006 | Viljanmaa et al. | 162/206 |
| 2007/0023155 | A1 * | 2/2007 | Iijima et al. | 162/205 |
| 2008/0295987 | A1 * | 12/2008 | Pietikainen et al. | 162/197 |
| 2008/0314536 | A1 | 12/2008 | Peng et al. | |
| 2010/0252215 | A1 * | 10/2010 | Kylliainen et al. | 162/100 |
| 2013/0020044 | A1 * | 1/2013 | Kylliainen et al. | 162/358.3 |

FOREIGN PATENT DOCUMENTS

| | | | |
|---|---|---|---|
| DE | 102007031366 | A1 * | 1/2008 |
| EP | 0828028 | | 3/1998 |
| EP | 828028 | A2 * | 3/1998 |
| EP | 1314818 | A1 * | 5/2003 |
| EP | 1314819 | | 5/2003 |
| EP | 2072672 | A1 * | 6/2009 |
| GB | 2062716 | A * | 5/1981 |
| WO | 98/44196 | | 10/1998 |
| WO | 03/064762 | | 8/2003 |
| WO | 2006084883 | | 8/2006 |
| WO | 2006/129871 | | 12/2006 |
| WO | 2008/000885 | | 1/2008 |

* cited by examiner

BOARD OR PAPER PRODUCED IN AN ARRANGEMENT IN CONNECTION WITH THE PRESS SECTION OF A WEB-FORMING MACHINE

CROSS REFERENCE TO RELATED APPLICATION

This application is a division of U.S. application Ser. No. 12/746,790 filed Jun. 8, 2010 now abandoned which is a national stage application of PCT/FI2008/050724 filed Dec. 10, 2008 which claims priority from EP application 07150199.3 filed Dec. 20, 2007.

TECHNICAL FIELD

The present invention relates to an arrangement in connection with the press section of a web-forming machine, which arrangement includes

- at least one press nip for dewatering the web manufactured on a web-forming machine, and
- a smoothing press including a smoothing roll arranged after the press nip.

The present invention also relates to a board or paper produced in such arrangement.

BACKGROUND OF THE INVENTION

In the press section of a web-forming machine lots of water is rapidly removed from the web. The press section has usually one or two press nips and press felts are also used. The press nip is often formed of two rolls arranged to be loaded against each other.

The quick removing of water causes surface densification of the same side of the web where the water is removed. Simultaneously, an oil absorption reduction appears and the print quality degrades. To avoid these problems a smoothing press is arranged after the press section. Traditionally the smoothing press includes two rolls forming a nip. The web is thus pressed in the nip without any press felt. Due to this fact water is not removed from the web in the smoothing press. However, both surfaces of the wet web get smoother which improves drying of the web in the drying section.

One target in the web-forming is to maintain both sides of the web as symmetrical as possible. However, this has occasionally required very complicated structures in the press sections and smoothing presses. Also, when heating the paper or board some problems have occurred. In the conventional short heated smoothing nip the water may turn to steam with a sudden heat or press impulse. This leads to delamination of the web. Furthermore the brightness and opacity of the web may decrease and the web can stick to the surfaces, for example to the surface of the roll.

SUMMARY OF THE INVENTION

The invention is intended to create a new type of arrangement in connection with the press section of a web-forming machine by means of which arrangement the quality of the surfaces of the web can be improved together with better drying properties. The characteristic features of this invention are stated in the accompanying Claims. The arrangement according to the invention is a new kind of combination of a press nip and a smoothing press. In the smoothing press according to the invention the web is heated efficiently without any risk of delamination. Simultaneously, both surfaces of the web get smooth which intensifies drying of the web. Other properties and advantages of the arrangement are discussed later. The paper or board produced in the arrangement according to the invention has surprisingly improved properties, above all, the initial smoothness of the paper or board product is improved resulting in improved stiffness and more efficient drying of the paper or board. Dry content of 60% or more enables smoothing with lower nip loads and without the need of moisturising. However, the smoothing press can be applied for paper or board products independent of the of content with appropriate moisturising and even just before reeling.

In the following, the invention is described in detail with reference to the accompanying drawings showing two embodiments of the invention, in which

DETAILED DESCRIPTION OF THE INVENTION

Figure 1:
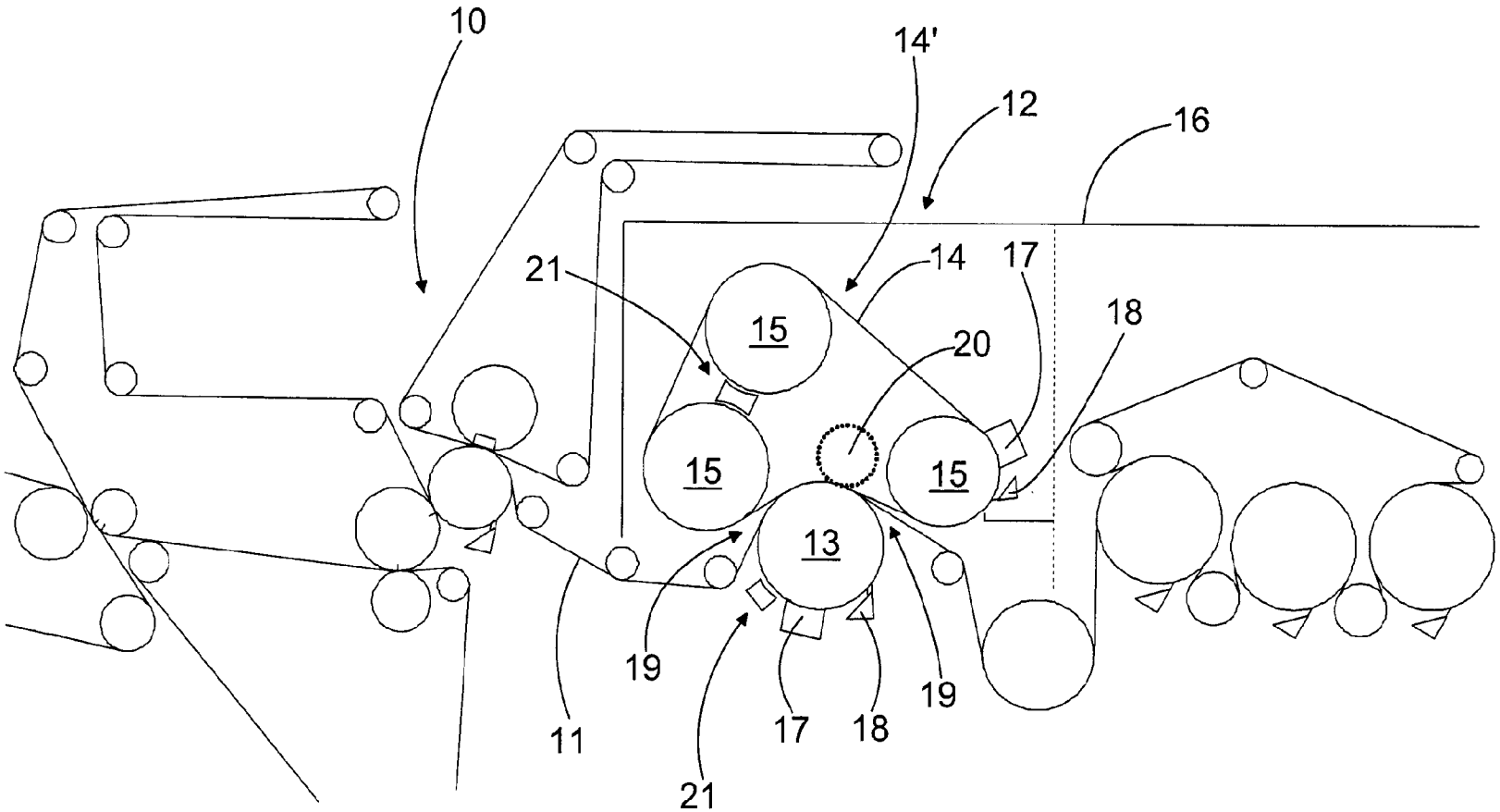
FIG. 1 shows a schematic drawing of a side view of the arrangement according to the invention.

Referring now to the drawings in detail, FIG. 1 shows an arrangement according to the invention in connection with the press section of a web-forming machine. The arrangement includes at least one press nip for dewatering the web 11 manufactured on a web-forming machine. In FIG. 1 there are actually three press nips. The arrangement also includes a smoothing press 12 including a smoothing roll 13. The smoothing press 12 is arranged after the press nip 10. When arriving to the smoothing press, the web has a dry content of 60% or more. According to the invention the smoothing press 12 also includes smooth heat carrying means 14', such as a belt 14. The belt is preferably made of metal. The metal belt is smooth and has no void volume for water removal. The belt 14 is arranged as a loop around at least two guide rolls 15. The smoothing roll 13 is then arranged into contact with the belt 14 between two guide rolls 15. Thus, a non-water removing long nip area is formed with the metal belt. During the processing of the web, the web is guided between the belt and the smoothing roll. Then both surfaces of the web will be smoothened in this long wrap metal belt smoothing nip. In addition, the smoothing roll 13 and/or at least one of the guide rolls 15 is arranged to be heated by steam. Thus, the web is also heated in an efficient way. In practice the rolls are internally heated, for example, with steam.

According to the invention, the press nip 10 is a roll nip or a long nip press. A long nip and low specific pressure in the press nip is very beneficial to the final bulk and bending stiffness of the paper or board. Preferably, the long nip press is a shoe press. With the shoe press a high amount of water can be removed from the web. This increases both bulk and dry content of the paper or board but it can make the surfaces of the web porous. However, the web is then smoothened in the smoothing press according to the invention. This results in a paper or board with improved bulk or in a paper or board with improved surface properties with standard bulk. Simultaneously, drying efficiency can be improved since the contact between the web and the drying rolls is improved. This results in, for example, reduced drying shrinkage in the cross direction of the paper or board. The belt and the smoothing roll have very smooth surfaces which is important in view of smoothing. Due to the long nip area in the smoothing press heat has time to penetrate through the web and thus also to increasing the temperature of the middle layer of the web.

Heating of a web influences the smoothness of the web. The smoothing press according to the invention has a more efficient heating equipment compared to prior art. First, the smoothing roll 13 can be a steam cylinder or a steam heated roll modified thereof. Secondly, at least one of the guide rolls 15 can be a steam cylinder or steam heated roll modified thereof. A combination of the first two embodiments is also possible. Also all guide rolls 15 can be steam cylinders or steam heated rolls modified thereof. Steam is very efficient source of heat and the structure of a steam cylinder is simple. The required temperatures can be achieved with a steam system of 1-10 bar. Temperatures of smoothing press are around 20-300° C., preferably 50-170° C. If needed, there can be also some auxiliary heating means 21 for the rolls 13, 15. The auxiliary heating means can include, for example an infrared, resistive, inductive or gas-burner heater. There can be also a combination of the above mentioned heaters and the belt can also be heated. Some special arrangements can also be equipped with the above mentioned auxiliary heating means without any steam heated solutions. In practice the diameter of the smoothing roll 13 and/or the guide roll 15 is 1000-2500 mm, preferably 1300-2000 mm. Thus, the nip area becomes long and the rolls are stiff. In spite of large rolls, the actual size of the smoothing press stays quite small. Preferably the smoothing press 12 also has an own hood 16. In this way it is possible to independently control the smoothing press and runaway heat flows can be avoided. Also excess or extra moisture can be handled with removal of moist air. The hood can also be common with the hood of the drying section.

In FIG. 1 there is an open draw from the press nip 10 to the smoothing press 12. The tail threading is handled for example by ropes arranged to the side of the press section. However, vacuum belt conveyors and air blowing can be used.

The belt can be made of metal, for example of steel. The thickness of the metal belt is about 1 mm. In order to achieve a stable run of the belt quite high tensions are needed. According to the invention, the tension of the belt 14 is 0.3-15 kN/m, preferably 5-10 kN/m. The position and alignment of one or more guide rolls can be adjusted. Thus, the smoothing press can be controlled for every situation.

The web may dust during smoothing. Also fibres, fines, chemical deposits or stickies can stick to the surface of the rolls or belt. According to one preferred embodiment of the invention, there are cleaning equipments 17 which include high-pressure water cleaners preferably in connection with both the smoothing roll 13 and the belt 14. The cleaners are used continuously and bigger particles are removed with doctors 18. For better cleaning results the temperature of the cleaning medium can be risen close to 100° C. which also reduces the cooling effect of the cleaners.

The smoothing effect of the smoothing press is achieved by long wrap metal belt nip area together with smooth surfaces of the belt 14 and the smoothing roll 13, and heating. The length of the nip is 500-2500 mm, preferably 1000-2000 mm. There is no need to press the web which would decrease the bulk. Thus, the smoothing press 12 has a linear load which is 1-150 kN/m, preferably 5-100 kN/m. This nip pressure can be adjusted for example by moving one guide roll. If additional pressing is needed the smoothing roll 13 can be equipped with a counter roll 20 which is arranged inside the belt 14 arranged as a loop. By loading the counter roll against the smoothing roll, the nip pressure is locally increased. The counter roll is preferably a crowned or tube roll.

The smoothing roll 13 is arranged into contact with the belt 14 between two guide rolls 15. The rolls are situated in such a way that the smoothing roll 13 and the belt 14 form two gaps 19 which open downwards. The gaps are under the loop which keeps the smoothing press clean if the threading tail breaks. Also, if something else other than the web enters into the closing gap, it will come out and fall underneath the smoothing press by way of gravity.

Figure 2:
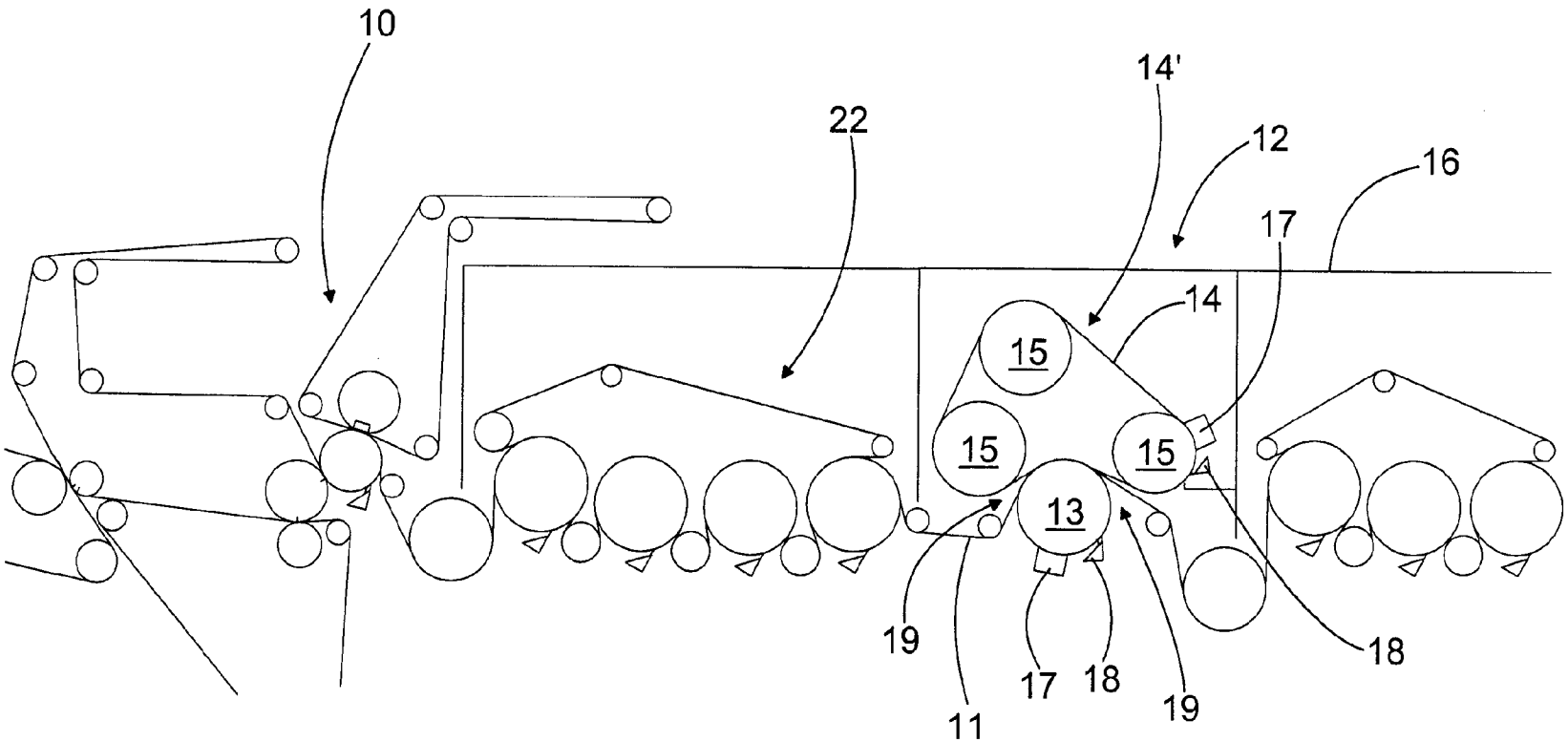
FIG. 2 shows a schematic drawing of a side view of the embodiment of the arrangement according to the invention.

The second embodiment of the present invention shown in FIG. 2 includes a dryer 22 arranged between the press section and the smoothing press 12. The dryer 22 is for increasing the temperature of the web and decreasing the water content therein. Thus the smoothing process becomes more effective. Here the dryer 22 includes four steam cylinders and one drying wire. This web-preheating arrangement according to FIG. 2 also enables less or no heating in the actual smoothing press.

In FIG. 1 and FIG. 2 the web is guided from the smoothing press to the drying section. Due to the smoothing press according to the invention the first drying cylinder can be warmer than previously. The above mentioned arrangement is advantageous when forming board and especially board with one or more plies. In known web-forming machines, the drying of the different plies of the board will occur at different times, i.e. the middle ply will have a different drying time than the top plies. Also, the shrinking forces of different plies are different in the top and middle of the web. In other words, when the top ply shrinks, the middle ply is still wet and cannot resist shrinkage. This causes defects of the surface properties of the board and especially in the edge areas of the board where the board can dry freely. With the smoothing press the temperature of the web can be raised. Thus, the effect of z-directional shrinkage difference can be minimized. Simultaneously, higher initial cylinder temperatures can be used in the drying section. This improves the drying capacity of the drying section as a whole. Also the improved smoothness of the web will increase the friction between drying cylinders and drying fabrics. This will improve the surface properties of the board especially in the edge areas.

The arrangement according to the invention is compact and it has many advantageous features. Due to the long wrap metal smoothing nip, the web has higher dry content than in the ordinary smoothing press. Also, the surfaces of both sides of the web are very similar. The components of this arrangement are simple so the founding costs are low. Also, there are only minor press felt markings on the web after leaving the smoothing press. The web has very good smoothness and bulk both after the press section and also for the end product. As mentioned earlier, this leads to improved contact between drying cylinders and drying fabrics. Also the drying shrinkage is reduced and the temperature transmission from drying cylinders to the web is improved. When the drying efficiency gets higher the production capacity can be improved or higher bulk can be achieved after the press section. When the smoothness is improved in the metal belt smoothing press there is less need for calendaring after the drying section. This leads to improved bending stiffness because the caliper of the web is improved. Also, the reduced z-directional temperature gradient leads to reduced drying roughening which improves the cross direction uniformity of the web.

The press section has few press nips. The structure of the press section is thus simple which improves the runnability of the press section and reduces the investment costs. This gives a short payback period for the smoothing press arrangement according to the invention. Also, the space needed for the press section is reduced. The metal belt smoothing press also has effect on the strength properties of the end product. In practice, a minimum web stretch on the press section keeps the and/cd strength property ratio down. This kind of ratio is desirable for packaging board end uses. Also, both sides of the board have improved similarity. The smoothing press also changes the surface properties of the web. Also, it is possible to adjust the temperatures of the sides of the paper or board in the smoothing press. Hence, it is easy to change the sidedness of the paper or board. When the web is already preheated in the smoothing press, higher initial cylinder temperature can be used in the drying section without fiber picking and dusting or linting problems.

The press section is intended for dewatering and/or processing paper of board webs. The board can have one or more plies. Liquid packaging board and cup stock board are preferable end products. In spite of the end use, the board has no warpage or curling and it has a good stiffness. According to the invention, the heating means or heat carrying means or cleaning equipment includes one or more suitable device for heating, heat carrying or cleaning, respectively.

The boards are divided into a number of different types, depending on their intended end use. Each application makes different demands on the properties of the board and each board type therefore implies certain characteristics, such as strength properties, internal bonding (Scott Bond ($J/m^2$), bending resistance index ($Nm^6/kg^3$), taint/odour (hexanal value (ppb)); brightness (ISO) (%) and edge penetration. The different board applications of this invention are therefore characterized by means of parameters, which correspond to their intended end use. The following methods and standards apply both to the definitions of the appended claims.

The edge penetration is a measure of hydrophobicity and sizability and is measured by an edge penetration test EWT (Edge Wick Test) according to the following method: board samples are conditioned at 23° C., 50% RH for 10 minutes. The samples are then cut to a specific size and the thickness of the samples is measured. The samples are then covered on both sides with a waterproof tape, the edges of the samples are thus uncovered, and the weight of the samples is measured. The size of the samples is for example 25×75 mm. Thereafter, the samples are put into a test solution (bath) for a certain period of time: lactic acid (concentration 1%, 1 hour), hydrogen peroxide (concentration 35%, 70° C., 10 minutes), cream coffee (11 tap water, 9.5 g instant coffee, 17.5 g dry cream, 80° C., 10 minutes). The weight of the samples is measured after the samples have been in the bath. The wick index is then calculated by the formula:

$$E = \frac{W_2 - W_1}{t \cdot l}$$

where

E=Wick index [$kg/m^2$]

$W_1$=weight before bath [mg]

$W_2$=weight after bath [mg]t=thickness (μm)

l=total length of the edges of the samples [m]

Hexanal is measured within one week from production of the board according a gas chromatography method, in which a sample is heated in a headspace (Perkin Elmer HS 40XL) to a temperature of 90° C. for 40 minutes, and the gas formed is conducted to the gas chromatograph (AutoSystem XL with a FID), where the components of the sample are separated. The amount of hexanal is measured in ppb (μg/kg).

Bending resistance is measured according to SCAN-P 29:95(L&W 15 degrees). Bending resistance index (F) is calculated: $F=10^6*F_b/w^3$ ($Nm^6/kg^3$), where w grammage ($g/m^2$) and $F_b$ is bending resistance (mN). The bending resistance index refers to the geometrical bending resistance index, which is calculated $F_{geom}=(F_{md}*F_{cd})^{0.5}$, where $F_{md}$ is the bending resistance index in the machine direction and $F_{cd}$ is the bending resistance index cross the machine direction.

The following properties are measured according to the standards indicated:

Scott Bond: TAPPI UM-403,

Roughness Bendtsen: SCAN-P 84,

Brightness (ISO): ISO 2470,

CD stretch to break: SCAN-P 67.

The value of roughness is measured before the board is pre-calendered or calendered. The roughness can either be measured on the web by open the calender and then measure the roughness or a sample can be cut out of the web and the roughness can then be measured on the sample. The other parameters, such as Scott Bond, bending resistance, hexanal and EWT are measured on the finished board.

In one preferred embodiment of the invention the board has an initial roughness Bendtsen value below 1000 ml/min, a Scott Bond of 120-350 $J/m^2$, a bending resistance index of 8-25 $Nm^6/kg^2$, a hexanal value below 600 ppb when measured within one week from the board manufacture and an EWT (lactic acid) value below 2 $kg/m^2$ and/or an EWT (hydrogen peroxide) value below 2 $kg/m^2$. The board of this embodiment has high cleanliness, high strength and good hydrogen peroxide and/or lactic acid penetration values, all which is important for packages containing liquid. It fulfils the demands for use as a liquid packaging board, and is thus suitable for the manufacture of packages for holding liquids, such as milk or juice cartons.

In another embodiment of the invention, the board has an initial roughness Bendtsen value below 1000 ml/min, a bending resistance index of at least 5 $Nm^6/kg^3$, a Scott Bond value of at least 160 $J/m^2$, a CD (cross direction) stretch to break of at least 2.5%, preferably 3.5%, a hexanal value below 600 ppb when measured within one week from the board manufacture, preferably below 400 ppb, and an EWT (cream coffee) value below 1.8 $kg^2/m^2$. This board grade has high formation, high cleanliness as well as a good CD stretch value, which fulfils the demands of cup stock board, and is thus suitable for use in the manufacture of cups for holding liquids, such as coffee or other beverages.

In a further embodiment of the invention, the board has an initial roughness Bendtsen value below 1000 ml/min, a Scott Bond value of at least 130 $J/m^2$, a hexanal value below 1000 ppb when measured within one week from the board manufacture and a brightness (ISO-UV; measured with 420 nm filter) of at least 82% for the uncoated board. The board of this embodiment has good strength and optical properties and fulfils the demands of a graphical paperboard, and is thus suitable for use as a graphical board and for packages holding for example pharmaceuticals or cosmetics.

In yet another embodiment of the invention, the board has an initial roughness Bendtsen value below 1000 ml/min, a bending resistance index of at least 5 $Nm^6/kg^3$, a Scott Bond value of at least 130 $J/m^2$, a CD stretch to break of at least 2.5%, preferably 3.5% and a hexanal value below 600 ppb when measured within one week from the board manufacture, preferably below 400 ppb. The board of this embodiment has high cleanliness in combination with good strength and CD stretch, and fulfils the demands of food service board, which makes it suitable for use as food service board and in the manufacture of packages for foodstuff, especially packages in which the foodstuff comes into direct contact with the board.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. Arrangement in connection with the press section of a web-forming machine, which arrangement includes at least one press nip for dewatering the web manufactured on a web-forming machine, and a smoothing press including a smoothing roll arranged after the press nip, characterized in that the smoothing press includes a smooth metal belt arranged as a loop around at least two guide rolls, and the smoothing roll is arranged into contact with the smooth metal belt between said two guide rolls so that the smoothing roll is lower than said two guide rolls thus forming two gaps which open downwards, the smoothing roll and/or at least one of the guide rolls is a steam heated drying cylinder, and the smoothing roll and the guide rolls are generally the same size.

2. Arrangement according to claim 1, characterized in that the smoothing press is arranged in the direction of motion of the web when the dry content of the web is 60% or more.

3. Arrangement according to claim 1, characterized in that the smoothing roll and/or at least one of the guide rolls is arranged to be heated by steam, infrared, resistive, inductive or gas-burning heating means.

4. Arrangement according to claim 1, characterized in that all guide rolls are steam cylinders.

5. Arrangement according to claim 1, characterized in that the diameter of the smoothing roll and/or the guide roll is 1000-2500 mm.

6. Arrangement according to claim 1, characterized in that the smoothing press has a hood.

7. Arrangement according to claim 3, characterized in that the tension of the belt is 0.3-15 kN/m.

8. Arrangement according to claim 1, characterized in that in connection with both smoothing roll and belt there are cleaning equipments which include high-pressure water cleaners.

9. Arrangement according to claim 1, characterized in that the smoothing press has a linear load which is 1-150 kN/m.

10. Arrangement according to claim 1, characterized in that the smoothing roll has a counter roll which is arranged inside the belt arranged as a loop.

11. Arrangement according to claim 1, characterized in that in connection with the smoothing press there are auxiliary heating means for heating the web and/or the smooth metal belt.

* * * * *